US010918934B2

(12) United States Patent
Peregoy

(10) Patent No.: US 10,918,934 B2
(45) Date of Patent: Feb. 16, 2021

(54) GOLF GLOVE COMPRISING ENHANCED GRIPPING FEATURE

(71) Applicant: Kelley Peregoy, Lillington, NC (US)

(72) Inventor: Kelley Peregoy, Lillington, NC (US)

( * ) Notice: Subject to any disclaimer, the term of this patent is extended or adjusted under 35 U.S.C. 154(b) by 20 days.

(21) Appl. No.: 15/652,762

(22) Filed: Jul. 18, 2017

(65) Prior Publication Data

US 2019/0022512 A1 Jan. 24, 2019

(51) Int. Cl.

| | |
|---|---|
| ***A63B 71/14*** | (2006.01) |
| ***A41D 19/015*** | (2006.01) |
| ***A41D 27/28*** | (2006.01) |
| ***A63B 71/08*** | (2006.01) |

(52) U.S. Cl.

CPC ..... *A63B 71/146* (2013.01); *A41D 19/01523* (2013.01); *A41D 27/28* (2013.01); *A63B 71/081* (2013.01); *A41D 19/01558* (2013.01); *A41D 2400/10* (2013.01)

(58) Field of Classification Search

CPC ..... A63B 71/146; A63B 71/081; A41D 19/01523; A41D 19/01558; A41D 27/28; A41D 2400/10

See application file for complete search history.

(56) References Cited

U.S. PATENT DOCUMENTS 2,083,935 A * 6/1937 Arnold ..... A41D 19/01529 2/159
2,952,021 A * 9/1960 Finn ..... A63B 71/148 2/20
3,255,462 A * 6/1966 Antonious ..... A63B 71/146 2/161.3
4,071,913 A * 2/1978 Rector ..... A41D 19/01523 2/161.1
4,603,439 A * 8/1986 Golomb ..... A63B 71/145 2/18
4,745,635 A * 5/1988 Kinnear ..... A41D 19/0068 2/161.6
4,918,755 A 4/1990 Kinnear
5,140,721 A 8/1992 Kauffeld
5,214,799 A * 6/1993 Fabry ..... A41D 19/01523 2/161.6
5,603,118 A * 2/1997 Solomon ..... A41D 19/01523 2/160
5,697,104 A * 12/1997 Welton ..... A41D 19/01523 2/159

(Continued)

OTHER PUBLICATIONS

Sealed Air Corporation, Bubble Wrap Competition for Young Readers, http://www.sealedairprotects.com/yic/competition_home.html, 1997-2011.

(Continued)

*Primary Examiner* — Richale L Quinn

(74) *Attorney, Agent, or Firm* — Dogwood Patent and Trademark Law; Ashley D. Johnson

(57) ABSTRACT

The presently disclosed subject matter is directed to a golf glove that provides enhanced gripping of a golf club. The golf glove includes a compartment positioned within the inside surface of the glove that houses padding material, adjacent to the user's fingers, thumb, and or palm. As a result, the user's grip pressure is reduced to an acceptable level, thereby reducing or eliminating overgripping of the golf club.

17 Claims, 7 Drawing Sheets

(56) References Cited

U.S. PATENT DOCUMENTS

| | | | | |
|---|---|---|---|---|
| 5,855,022 | A * | 1/1999 | Storto | A63B 71/146 2/161.2 |
| 5,926,847 | A * | 7/1999 | Eibert | A63B 71/146 2/161.2 |
| 5,987,642 | A * | 11/1999 | Webster | A41D 19/01523 2/161.1 |
| 6,216,276 | B1 * | 4/2001 | Eibert | A63B 71/146 2/161.2 |
| 6,618,860 | B1 * | 9/2003 | Sullivan | A63B 71/141 2/159 |
| 6,775,847 | B2 * | 8/2004 | Terris | A41D 19/01523 2/161.1 |
| 7,865,969 | B2 | 1/2011 | Auger et al. | |
| 8,429,765 | B2 * | 4/2013 | Africa | A41D 19/01523 2/160 |
| 9,572,383 | B2 * | 2/2017 | Kleinert | A41D 13/081 |
| 2002/0182419 | A1 * | 12/2002 | Cho | B32B 3/12 428/423.1 |
| 2004/0148685 | A1 | 8/2004 | Messinger | |
| 2006/0137067 | A1 * | 6/2006 | Wu | A41D 19/015 2/19 |
| 2006/0195968 | A1 * | 9/2006 | Powell | A41D 19/01523 2/161.1 |
| 2007/0113317 | A1 * | 5/2007 | Garneau | A41D 19/01523 2/161.1 |
| 2007/0245451 | A1 * | 10/2007 | Desjardins | A41D 19/01523 2/159 |
| 2012/0011633 | A1 * | 1/2012 | Van Hale | A41D 19/002 2/20 |
| 2012/0258317 | A1 * | 10/2012 | Demmig | C08G 18/0823 428/423.1 |

OTHER PUBLICATIONS

Tribord, 3 mm Neoprene Surf Gloves, https://www.tribord.co.uk/3-mm-neoprene-surf-gloves-id_8158443, Sep. 3, 2016.

* cited by examiner

GOLF GLOVE COMPRISING ENHANCED GRIPPING FEATURE

TECHNICAL FIELD

The presently disclosed subject matter relates to a golf glove that comprises an enhanced gripping feature. Specifically, the presently disclosed subject matter relates to golf gloves used to assist the user in properly gripping and manipulating a golf club.

BACKGROUND

It is well known that a proper grip is essential to success in the game of golf. Despite the use of a golf glove, the golfer must grasp the club grip portion with his gloved hand, relying on the muscles in the hand and forearm to create a grip with decreased pressure and/or tension to prevent the golf ball from blocking or hooking upon impact. Many types of gloves have been developed to aid a player when playing golf. For example, U.S. Pat. No. 4,000,903 to Swanson is directed to a golf glove that employs padding placed across the palm area of the hand. However, current golf teachings recommend that the golf club be gripped in the fingers rather than the palm of the hand. It would therefore be beneficial to provide a golf glove that enables enhanced gripping of the golf club in the finger portion of the glove. It would further be beneficial to provide a golf glove that insulates the user's hand when exposed to cold temperatures.

SUMMARY

In some embodiments, the presently disclosed subject matter is directed to a golf glove comprising a palm side and a dorsal side collectively defining a palm, fingers, and a thumb. The glove further comprises a compartment wall extending from an inner facing surface of the palm side of the glove to define a compartment therebetween. The compartment comprises padding material positioned between the compartment wall and the inner facing surface of the glove. In some embodiments, the padding material includes air cellular material comprising bubbles of trapped air. The compartment wall does not extend to the dorsal side of the glove.

In some embodiments, the presently disclosed subject matter is directed to a method of gripping the handle of a golf club. Particularly, the method comprises placing a golf glove on the hand, the golf glove comprising a palm side and a dorsal side collectively defining a palm, fingers, and a thumb. The golf glove further includes a compartment wall extending from an inner facing surface of the palm side of the glove to define a compartment therebetween. The compartment comprises padding material positioned between the compartment wall and the inner facing surface of the glove, wherein the padding material includes air cellular material comprising bubbles of trapped air. The compartment wall does not extend to the dorsal side of the glove. The method further includes gripping the handle of the golf club in a manner that brings the padding in contact with the golf club grip.

In some embodiments, the palm side of the fingers and thumb, dorsal side of the fingers and thumb, or both comprise ventilation holes. In some embodiments, the ventilation holes extend through the inner facing surface of the palm side of the glove. In some embodiments, the ventilation holes extend into the padding material. In some embodiments, the ventilation holes extend through the padding material. In some embodiments, the ventilation holes extend through the compartment wall.

In some embodiments, the glove is constructed from leather, synthetic leather, fabric, elastic material, soft plastic, nonwoven material, or combinations thereof.

In some embodiments, the padding further includes foam material, cotton, embossed paper, rubber, polymeric material, or combinations thereof.

In some embodiments, the bubbles are about 1/16 of an inch to 1/8 of an inch in thickness.

In some embodiments, the bubbles are filled to less than capacity.

In some embodiments, the padding has a thickness of 3/4 of an inch or less.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a glove" can include a plurality of such gloves, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1A:
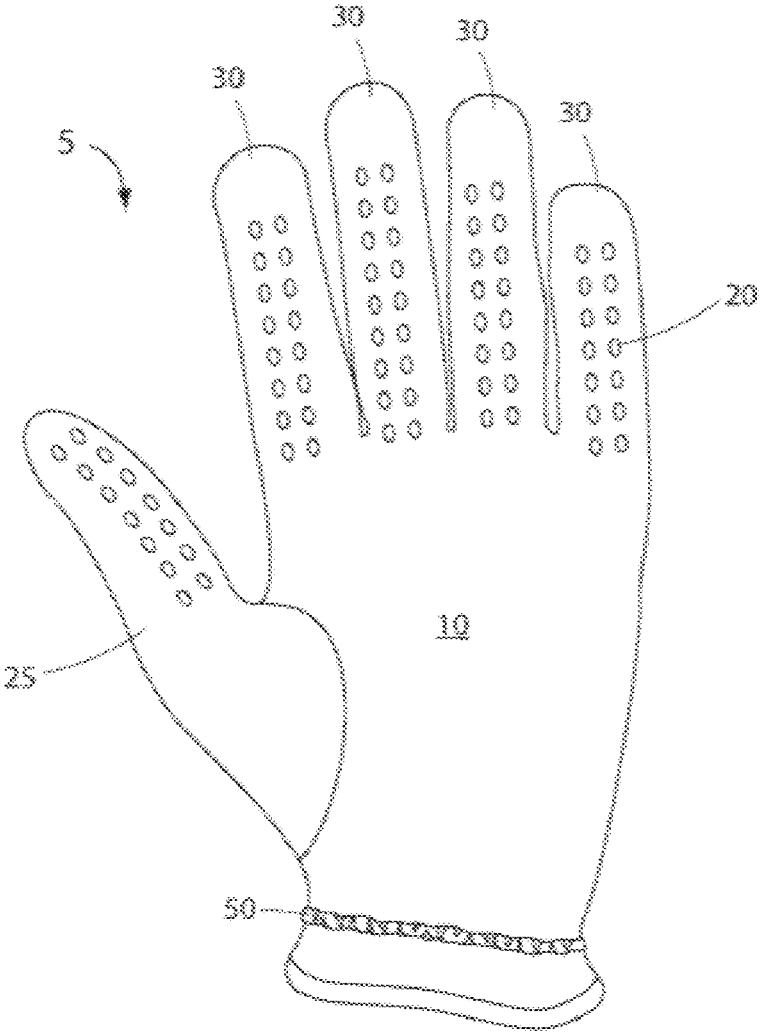
FIG. 1*a* is a plan view of the palm side of a golf glove in accordance with some embodiments of the presently disclosed subject matter.
Figure 1B:
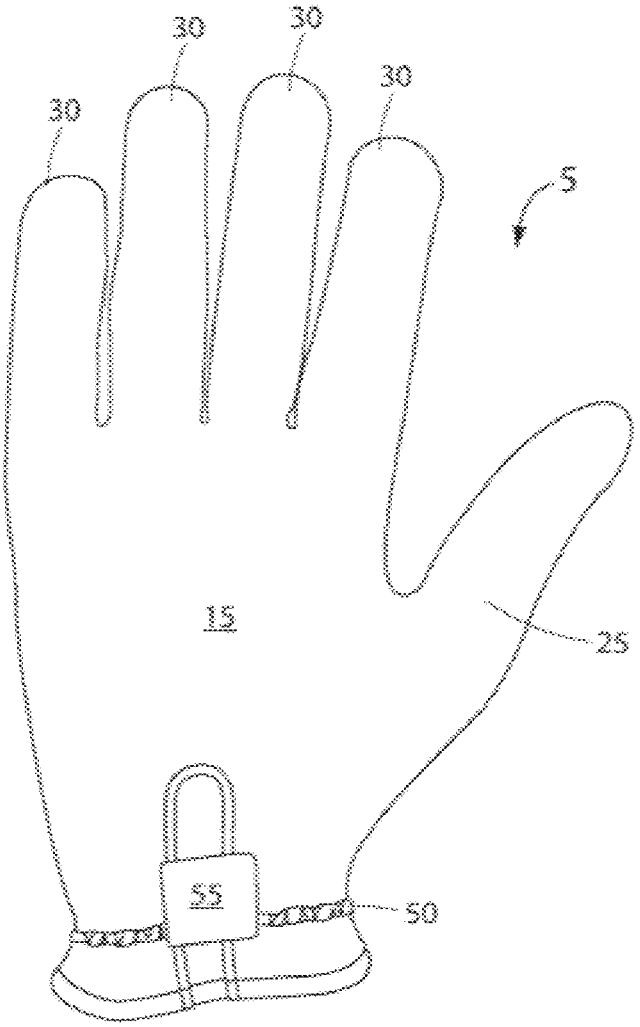
FIG. 1*b* is a plan view of the dorsal side of the golf glove of FIG. 1*a*.

The presently disclosed subject matter is directed to a golf glove that provides enhanced gripping of a golf club. Particularly, FIGS. 1*a* and 1*b* illustrate one embodiment of golf glove 5 of the type often worn by golfers to ensure a firm grip on a golf club handle. Golf glove 5 is defined by palm side 10 (FIG. 1*a*) and dorsal side 15 (FIG. 1*b*). "Palm side" refers to the planar surface that interfaces with the palm of a golfer. "Dorsal side" refers to the back surface of glove 5 that interfaces with the back side of a golfer's hand. Both palm and dorsal sides include thumb 25 and fingers 30. The glove further includes wrist portion 50 that can be tightened around the user's wrist using, for example, elastic, snaps, buttons, or other fasteners to ensure a good fit. In some embodiments, the dorsal side of glove 5 includes closure assembly 55 that can be constructed from a hook and loop material, such as (but not limited to) VELCRO®. In some embodiments, the dorsal surface and/or palmar surface of fingers 30 are perforated with ventilation holes 20.

Figure 2:
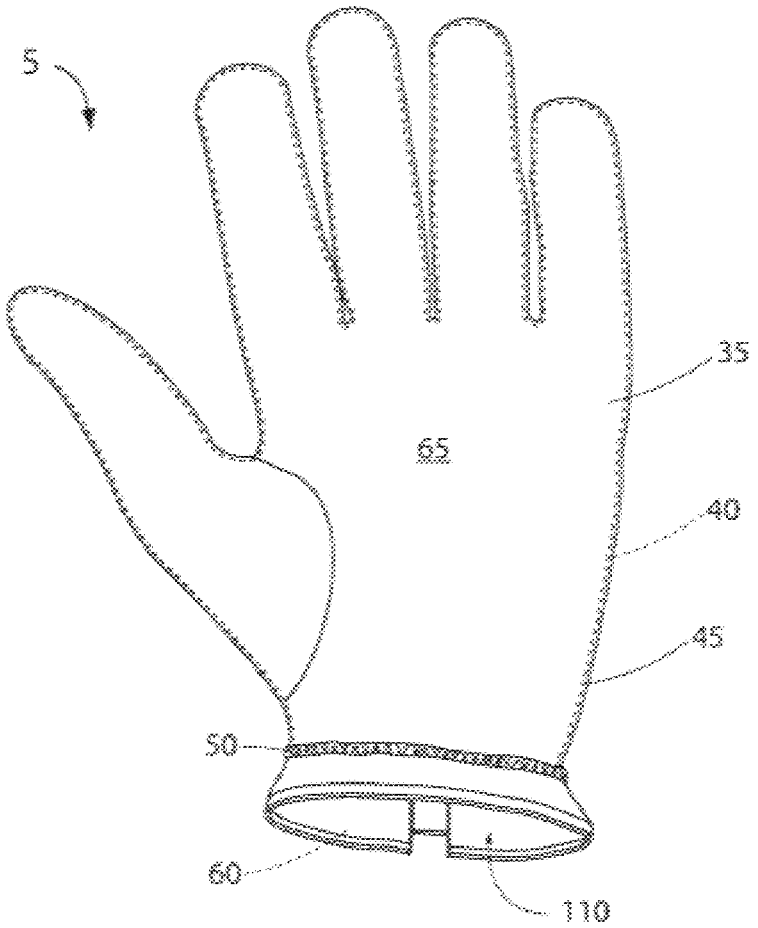
FIG. 2 is a perspective view of a golf glove in accordance with some embodiments of the presently disclosed subject matter.

As shown in FIG. 2, glove 5 can be constructed with top element 35 and bottom element 40 that are joined together by sewing, adhesives, mechanical closures, and the like along perimeter seam 45. As shown, the perimeter seam does not extend to wrist area 50, thereby providing opening 110 to allow the user to insert and remove his or her hand when desired. Top element 35 forms the palm side of glove 5, and bottom element 40 forms dorsal side 15. Glove 5 comprises inside surface 60 that contacts the hand of the user, and outside surface 65 that contacts the outside environment (e.g., the golf club).

Figure 3A:
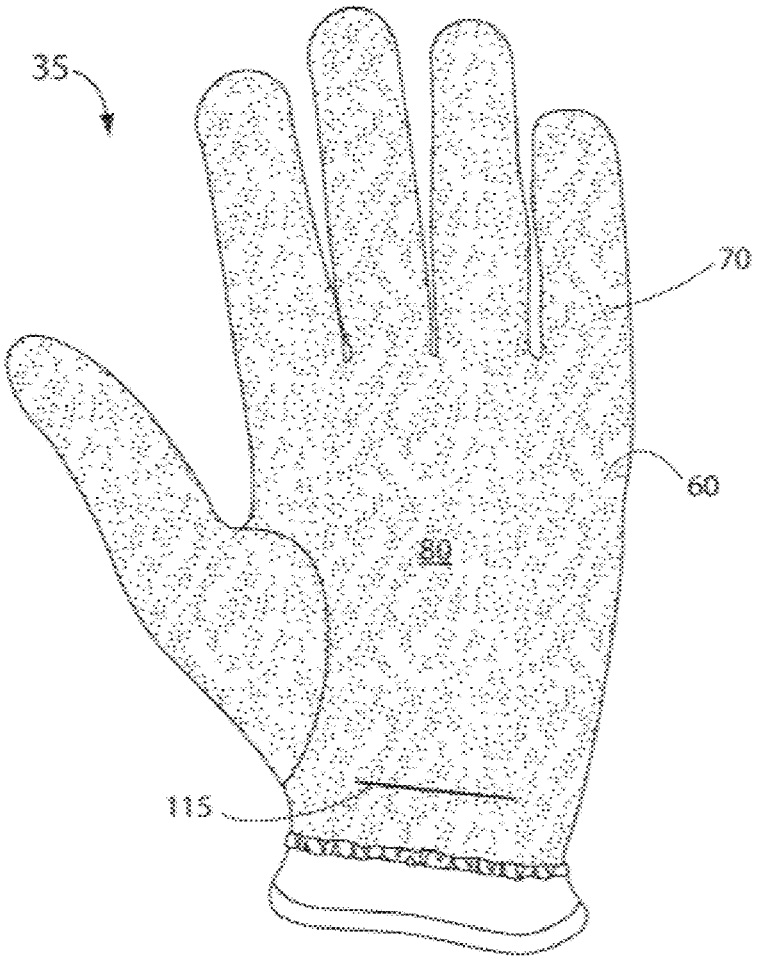
FIGS. 3*a* and 3*b* are plan views of two embodiments of an interior face of the disclosed golf glove comprising an interior compartment.
Figure 3B:
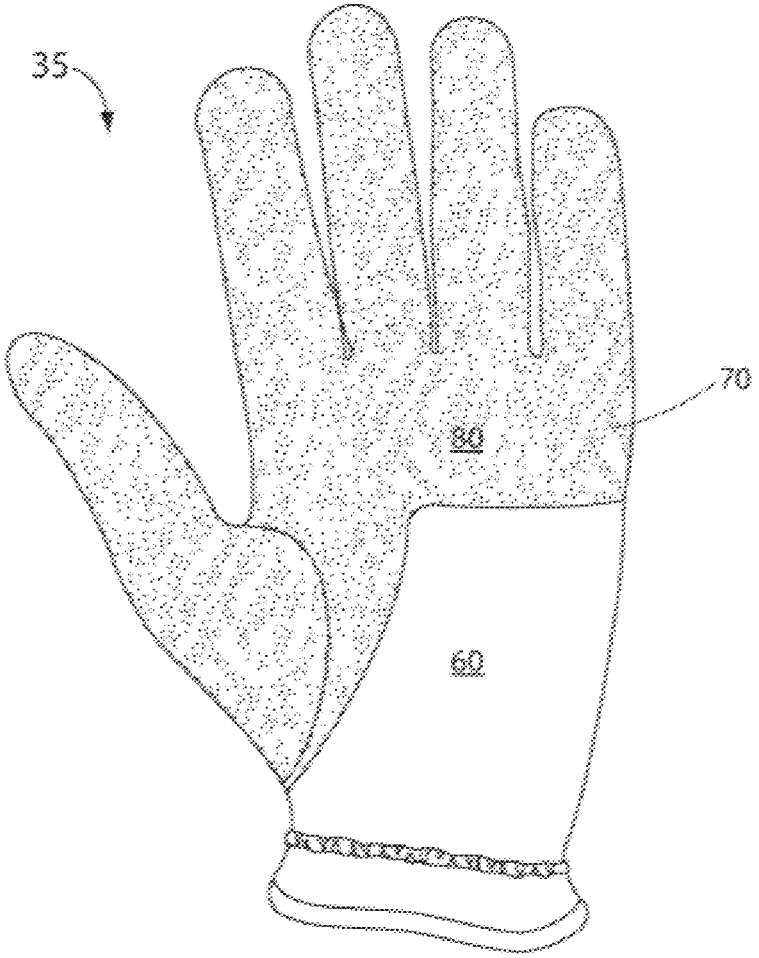

Inside surface 60 of top element 35 comprises compartment 70 that in use contacts the front side (e.g., palm-containing side) of a user's hand. To this end, FIGS. 3*a* and 3*b* illustrate compartment wall 80 attached to inside surface 60 of the top element to form compartment 70. The term "compartment" is expansively defined as a structure for storing padding material, and can include a pocket, pouch, receptacle, or combinations thereof. Thus, wall 80 is connected to the inside surface of top element 35 along at least a portion of the wall edges. As shown in FIG. 3*a*, in some embodiments, compartment 70 can span a region immediately adjacent to the thumb, palm, and/or fingers of the inside surface of top element. Alternatively, compartment 70 can span the thumb and/or finger areas of the interior of the glove, as shown in FIG. 3*b*. In use, compartment 70 therefore does not touch or contact the dorsal side (back side) of the user's hand. Rather, it only comes into contact with the user's front (palm-containing) side of the hand.

Compartment 70 houses padding 75, which ensures a proper grip on the golf club when worn and also has an insulating effect on the user's hand during cold weather. The term "padding" as used herein refers to any of the wide variety of filler materials known or used in art, including (but not limited to) foam material, BUBBLE WRAP® air cellular material, cotton, embossed paper, rubber, or combinations thereof. In some embodiments, padding 75 can comprise one or more materials that are force-dispersing. In some embodiments, the padding can comprise a flexible and/or pliable material. Compartment 70 can include one or more layers of padding material, such as one or more layers of BUBBLE WRAP® packaging material that include bubbles or blisters of trapped air to provide a cushion strip. The padding provides a cushion grip for gripping the golf club and provides thermal insulation from cold weather.

Thus, for example, compartment 70 can include padding 75 that comprises air cellular material, such as BUBBLE WRAP® packaging material. As would be known in the art, BUBBLE WRAP® packaging material includes a plurality of air-filled bubbles formed in a plastic sheet material. In some embodiments, the surface of the padding facing the user's fingers comprises the air-filled bubbles and has a knobbed texture. Advantageously, the bubbles are springy, resilient, and non-compacting. In addition, the area in between the bubbles form an open space that allows the padding to breathe and contributes to the lightweight nature of the material. In some embodiments, the air-filled bubbles are filled to less than capacity to allow the bubbles to deform and conform to the fingers when pressure is applied during gripping of the golf club. In some embodiments, the bubbles can be of uniform size, with a thickness that ranges in size from about 1/16 of an inch to 1/4 of an inch (i.e., 1/16, 1/12, 1/10, 1/8, 1/7, 1/6, 1/5, or 1/4 of an inch). The BUBBLE WRAP® packaging material can be formed by preforming one sheet with bubble pockets, and conduits if necessary, and laminating an outer sheet by forming the outer sheet on the pocketed sheet or laying the two sheets together and fusing the sheets with heat. Alternatively, the sheets may be laid together and bubble pockets formed with heated vacuum molds before raising the inner lamina temperature to a heat-sealing temperature.

In some embodiments, padding 75 can have a thickness of about 0.75 inches or less. Thus, the padding can have a thickness of at least about (or no more than about) 0.75, 0.7, 0.65, 0.6, 0.55, 0.5, 0.45, 0.4, 0.35, 0.3, 0.25, 0.2, 0.15, 0.1, 0.05, or 0.01 inches.

Figure 4:
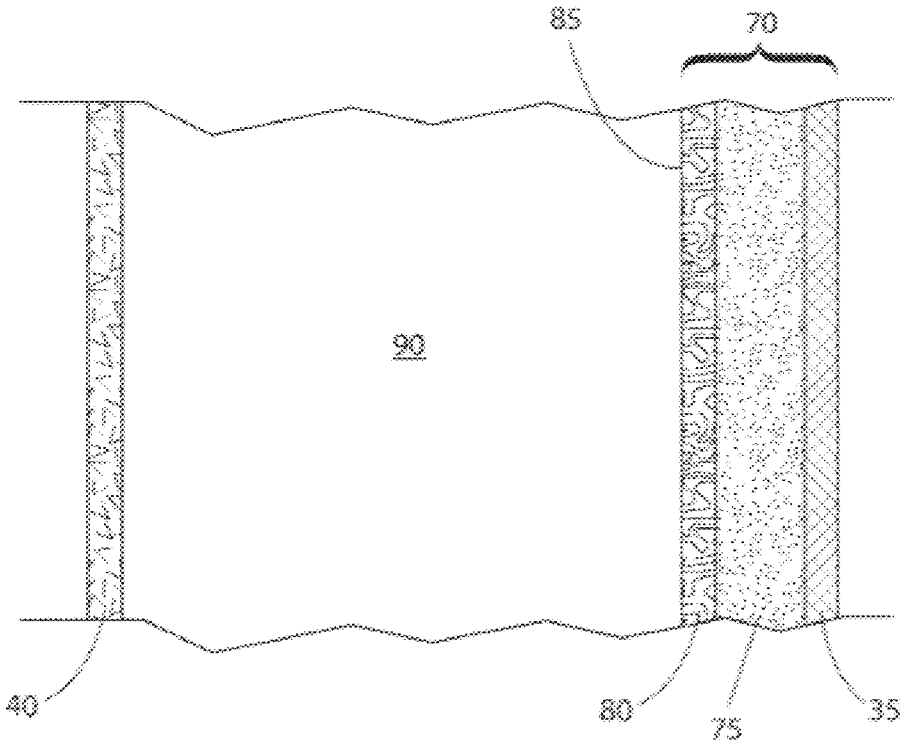
FIG. 4 is a cross-sectional view of a golf glove according to some embodiments of the presently disclosed subject matter.

As shown in the cross-sectional view of FIG. 4, inner surface 85 (i.e., the surface that includes the palm) of user's hand 90 contacts compartment wall 80 when the glove is worn. Particularly, compartment wall 80 contacts the inner surface of the user's fingers, thumb, and/or palm. Padding 75 is positioned between wall 80 and the interior of top element 35, thereby forming compartment 70. It should be appreciated that FIG. 4 (and all other figures) are not necessarily drawn to scale in some embodiments.

Top element 35, bottom element 40, and/or compartment wall 80 can include any known flexible material, such as (but not limited to) leather, synthetic material (e.g., synthetic leather, such as polyurethane coated nylon), fabric, cloth, elastic material, soft plastic, and/or nonwoven material. For example, in some embodiments, Cabretta leather, a well-known material for the manufacture of golf gloves, can be used. In some embodiments, the compartment wall can be constructed from a material that differs from the top and bottom elements. For example, compartment wall 80 can be constructed from any man-made fabric, synthetic fabric, or animal skin. In some embodiments, the compartment wall can be constructed from an elastic material to allow the compartment to conform to the contours of the user's hand to help facilitate a comfortable fit.

Compartment 70 extends through glove thumb 25, fingers 30, and/or palm 15 such that the padding reaches the user's fingers and thumb when the glove is worn, as shown in FIGS. 3*a* and 3*b*. In this way, padding 75 facilitates the proper fingertip grip by preventing the user from gripping a golf club too hard. Padding 75 can be attached within compartment 70 by sewing into proper position. Alternatively, in some embodiments, the padding can be secured in position through the user of adhesives, mechanical closures, and the like. In some embodiments, padding 75 lies freely within the compartment and is not secured in place by sewing, adhesives, etc. In some embodiments, wall 80 can include aperture 115 that permits the compartment to be selectively opened and closed through the use of zippers, hook-and-loop fasteners, adhesive strips, clasps, snaps, button, and/or combinations thereof, as depicted in FIG. 3*a*. In some embodiments, aperture 115 can be opened or closed on demand to allow the user to remove, add, or replace padding 75. In some embodiments, aperture 115 remains open to allow the user to access the padding at any desired time (i.e., the compartment is secured on three sides with aperture 115 positioned near wrist 50 of the glove). Alternatively, in some embodiments, glove 5 lacks aperture 15 and the user does not have access to padding 75.

Figure 5A:
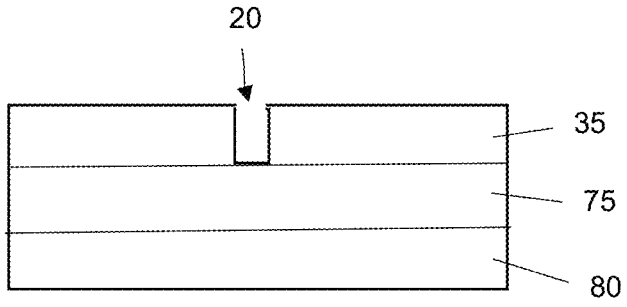
FIGS. 5*a*-5*c* are cross-sectional views of a golf glove depicting a ventilation hole in accordance with some embodiments of the presently disclosed subject matter.
Figure 5B:
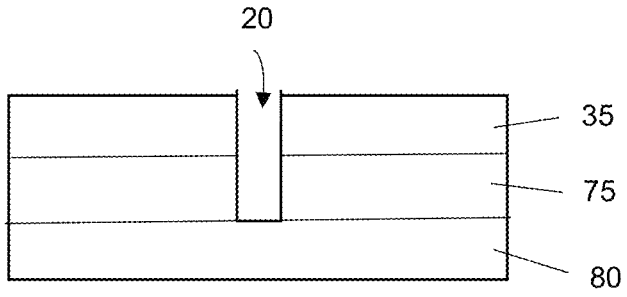
Figure 5C:
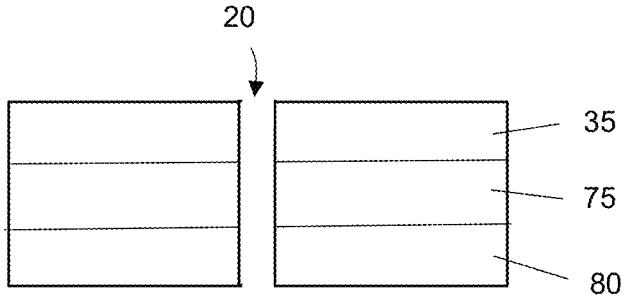

In embodiments wherein palm side 10 includes ventilation holes 20, it should be appreciated that the holes can extend through top element 35 only to assist in the breathability of the disclosed glove, as illustrated in FIG. 5*a*. Alternatively, in some embodiments, ventilation holes 20 can extend through the top element and into padding 75, as shown in FIG. 5*b*. It should be appreciated that when padding 75 comprises air cellular material, the ventilation holes are placed in the area between "bubbles" to ensure that the bubbles remain intact (i.e., are not popped). In some embodiments, the padding material (e.g., air cellular material) is perforated with ventilation holes prior to being inserted into compartment 80. In some embodiments, the ventilation holes can extend through the top element, padding 75, and compartment wall 80, as shown in FIG. 5*c*. Ventilation holes 20 can be constructed using any method known in the art, such as through the use of a piercing element, such as a needle.

Golf glove 5 can be fabricated in a conventional manner such that top and bottom elements 35, 40 are assembled separately and are sewn together or otherwise attached as a final step. For example, in some embodiments, compartment 70 can be attached to interior 60 of the top element prior to attachment to rear element 40. Wall 80 is then overlayed on top of the padding and attached to the inside surface of the palmar side of the glove using any conventional method (i.e., sewing, the use of adhesives, etc.). The resulting configuration is a top side of the golf glove, with a compartment positioned adjacent to the user's palm and interior surface of the fingers when in use. Bottom element 40 is then attached to top element 35, with compartment 70 configured therebetween, such that the thumb, finger, and wrist portions align. It should be appreciated that the steps used to construct glove 5 set forth above are not limiting and can be performed in any order.

Although the drawings illustrate a left-handed glove for a right-handed golfer, it should be understood that the presently disclosed subject matter also includes right-handed gloves.

When a golf club is gripped with glove 5, padding 75 facilitates proper gripping of the golf club. Particularly, padding 75 is positioned (within compartment 70) adjacent to the user's fingers and/or palm to facilitate a decrease in the user's grip pressure and/or tension. As a result, it is difficult for the user to apply too much grip pressure to the golf club. With proper grip pressure and/or tension, the user advantageously sees a decrease or elimination of blocking or hooking the ball when playing golf, often resulting from gripping the club too hard. Accordingly, glove 5 beneficially assists the user in properly gripping a golf club.

In addition, the disclosed glove protects the sensitive portions of the hand that are subject to stresses and abrasions when playing golf. Particularly, padding 75 is designed to reduce injuries, such as blisters, calluses and the like. The disclosed glove further provides insulation to the user when used on cold days by supplying an added layer of protection from the cold temperatures.

While the presently disclosed subject matter has been described with reference to specific embodiments, modifications and variations of the may be constructed without departing from the scope of the invention, which is defined in the following claims.

What is claimed is:

1. A golf glove comprising:

a palm side and a dorsal side collectively defining complete palm, fingers, and thumb portions, each portion terminating in an enclosed tip;

a single compartment wall extending from an inner facing surface of the palm side of the glove to define a single compartment therebetween that spans a region immediately adjacent to and including either:

the thumb and finger portions, or the thumb, finger, and palm portions;

wherein the compartment contains a single layer of padding material positioned between the compartment wall and the inner facing surface of the glove, wherein the padding material includes air cellular material comprising bubbles of trapped air, wherein the bubbles of trapped air are formed between two plastic sheets of material engaged therewith;

wherein bubbles of trapped air are formed in the finger portions of the glove, and wherein the compartment wall does not extend to the dorsal side of the glove.

2. The golf glove of claim 1, wherein the single layer of padding material is defined by a uniform thickness.

3. The golf glove of claim 1, wherein the palm side of the fingers and thumb comprise ventilation holes.

4. The golf glove of claim 1, wherein the ventilation holes extend through the compartment wall.

5. The golf glove of claim 1, wherein the glove is constructed from leather, synthetic leather, fabric, elastic material, soft plastic, nonwoven material, or combinations thereof.

6. A golf glove comprising:

a palm side and a dorsal side collectively defining complete palm, fingers, and thumb portions, each portion terminating in an enclosed tip;

a single compartment wall extending from an inner facing surface of the palm side of the glove to define a single compartment therebetween that spans a region immediately adjacent to and containing the thumb portion of the glove, complete finger portions of the glove, and an area of the palm portion of the glove proximate to the complete finger and thumb portions of the glove;

wherein the compartment comprises padding material positioned between the compartment wall and the inner facing surface of the glove, wherein the padding material includes air cellular material comprising bubbles of trapped air, wherein the bubbles of trapped air are formed between two plastic sheets of material engaged therewith;

wherein bubbles of trapped air are formed in the finger portions of the glove, and wherein the compartment wall does not extend to the dorsal side of the glove, and wherein the single compartment wall includes an aperture that can be opened or closed on demand.

7. The golf glove of claim 6, wherein the bubbles are about 1/16 of an inch to 1/8 of an inch in thickness.

8. The golf glove of claim 6, wherein the bubbles are filled to less than capacity.

9. The golf glove of claim 6, wherein the padding has a thickness of 3/4 of an inch or less.

10. The golf glove of claim 6, wherein the padding further includes foam material, cotton, embossed paper, rubber, polymeric material, or combinations thereof.

11. The golf glove of claim 6, wherein the palm side of the fingers and thumb comprise ventilation holes.

12. The golf glove of claim 6, wherein the ventilation holes extend through the compartment wall.

13. The golf glove of claim 6, wherein the glove is constructed from leather, synthetic leather, fabric, elastic material, soft plastic, nonwoven material, or combinations thereof.

14. The golf glove of claim 1, wherein the padding further includes foam material, cotton, embossed paper, rubber, polymeric material, or combinations thereof.

15. The golf glove of claim 1, wherein the bubbles are about 1/16 of an inch to 1/8 of an inch in thickness.

16. The golf glove of claim 1, wherein the bubbles are filled to less than capacity.

17. The golf glove of claim 1, wherein the padding has a thickness of 3/4 of an inch or less.

* * * * *